US007889164B2

(12) United States Patent
Ishii et al.

(10) Patent No.: US 7,889,164 B2
(45) Date of Patent: Feb. 15, 2011

(54) SEMICONDUCTOR INTEGRATED CIRCUIT DEVICE AND MOBILE TERMINAL DEVICE

(75) Inventors: Tatsuya Ishii, Tokyo (JP); Shin Morita, Tokyo (JP); Yuri Azuma, Tokyo (JP); Goro Sakamaki, Tokyo (JP)

(73) Assignee: Renesas Electronics Corporation, Kawasaki-shi (JP)

( * ) Notice: Subject to any disclaimer, the term of this patent is extended or adjusted under 35 U.S.C. 154(b) by 830 days.

(21) Appl. No.: 11/851,927

(22) Filed: Sep. 7, 2007

(65) Prior Publication Data

US 2008/0068390 A1 Mar. 20, 2008

(30) Foreign Application Priority Data

Sep. 15, 2006 (JP) ..... 2006-250631

(51) Int. Cl.
*G09G 3/36* (2006.01)

(52) U.S. Cl. ..... 345/87; 345/89; 345/204; 345/212; 345/213

(58) Field of Classification Search ..... 345/87–100, 345/204–215, 690
See application file for complete search history.

(56) References Cited

U.S. PATENT DOCUMENTS 6,501,451 B1 * 12/2002 Sakashita ..... 345/87
6,556,180 B1 * 4/2003 Furuhashi et al. ..... 345/87
6,825,824 B2 * 11/2004 Lee ..... 345/89
2006/0103620 A1 5/2006 Joo et al.
2006/0267925 A1 11/2006 Sakamaki et al.

FOREIGN PATENT DOCUMENTS

JP 2006-146220 A 6/2006
JP 2006-330551 A 12/2006

* cited by examiner

*Primary Examiner*—Vijay Shankar
(74) *Attorney, Agent, or Firm*—Miles & Stockbridge P.C.

(57) ABSTRACT

In a semiconductor integrated circuit device of a liquid crystal display drive controller, the present invention is intended to suppress an increase in the number of output terminals for interface control signals for control of parallel interface to a sub liquid crystal display controller. A host interface circuit comprises a first serial interface circuit for serial data input and output in a differential manner, a parallel interface circuit, and other interface circuits. When the first serial interface circuit is selected for use as the host interface, the host interface circuit outputs in parallel predetermined information input via the first serial interface circuit from the parallel interface circuit to outside and generates interface control signals for the parallel output. External terminals for host interface assigned to the other interface circuits are used for double duty to output the interface control signals.

11 Claims, 7 Drawing Sheets

SEMICONDUCTOR INTEGRATED CIRCUIT DEVICE AND MOBILE TERMINAL DEVICE

CROSS-REFERENCE TO RELATED APPLICATIONS

The disclosure of Japanese Patent application No. 2006-250631 filed on Sep. 15, 2006 including the specification, drawings and abstract is incorporated herein by reference in its entirety.

BACKGROUND OF THE INVENTION

The present invention relates to a liquid crystal display drive controller and a mobile terminal device including the liquid crystal display drive controller, and a technique that is effectively applied to, for example, mobile phones.

A mobile phone comprises a radio frequency interface section, a baseband section, a liquid crystal display drive controller, a liquid crystal display, and other components. If a fordable structure casing is adopted as a case encasing all internal circuits of the mobile phone, a pair of casing halves is coupled so as to be openable and closable by a hinge member. When the liquid crystal display drive controller and the liquid crystal display are disposed in one casing half, the baseband unit that provides a display command and display data to the liquid crystal display drive controller is generally disposed in the other casing half, together with the radio frequency interface unit. When the baseband unit and the liquid crystal display drive controller are disposed in separate casing halves, respectively, a great number of signal lines wired between them go through the hinge member.

Japanese Unexamined Patent Publication No. 2006-146220 suggests a future need for a high-speed serial interface function or the like to reduce the number of connection pins of the system interface of a liquid crystal display device.

SUMMARY OF THE INVENTION

However, despite that the high-speed serial interface is adopted, if a sub display capable of displaying moving images, still images, and the like is disposed in the same casing half that encloses the liquid crystal display, and if interface signal lines for control of the sub display are added, a total number of signal lines going through the hinge member increases. Therefore, the present inventors proposed in our previous application (Japanese Patent Application 2005-156938) an idea that consists of interfacing a liquid crystal display drive controller for a main display with a host system by using a high-speed serial interface circuit and supplying commands and display data for a sub display via the liquid crystal display drive controller for the main display to a liquid crystal display device for the sub display by using a parallel interface. With the use of the parallel interface, the following problem was found by the present inventors. The liquid crystal display drive controller for the main display needs to supply, additionally, parallel interface control signals such as a chip select signal and a write signal to the liquid crystal display drive controller for the sub display and this increases the number of external terminals for host interface of the liquid crystal display drive controller.

An object of the present invention is to provide a semiconductor integrated circuit device that can suppress an increase in the number of output terminals for interface control signals for control of parallel interfacing with an external component.

Another object of the present invention is to achieve cost reduction in terms of the number of external terminals of a liquid crystal display drive controller in a mobile terminal device with casing halves, wherein one casing half enclosing liquid crystal display drive controllers and a plurality of displays is foldably hinged to the other casing half via a hinge member.

The above-noted objects and other objects and novel features of the invention will become apparent from the description of the present specification and the accompanying drawings.

Typical aspects of the invention disclosed in the present application will be summarized below.

A semiconductor integrated circuit device (10) according to an aspect of the invention comprises external terminals for host interface (TML1); a host interface circuit (20) coupled to the external terminals for host interface; a display drive circuit (21) coupled to the host interface circuit; and external terminals for display drive (TML2) coupled to the display drive circuit. The host interface circuit comprises a first serial interface circuit (25) for serial data input and output in a differential manner; a parallel interface circuit (33); and other interface circuits, wherein an interface circuit for use as an interface with a host device is selected according to a host interface mode setting. When the first serial interface circuit is selected for use as the interface with the host device, the host interface circuit outputs in parallel predetermined information input from the host device via the first serial interface circuit from the parallel interface circuit to outside and generates interface control signals (cs, rs, wr) for the parallel output, wherein external terminals (SDO, HSYNC, ENABLE) for host interface assigned to the other interface circuits are used for double duty to output the generated interface control signals. According to this aspect of the invention, a high-speed serial interface is used as the interface between the semiconductor integrated circuit device of the present invention and the host device and, therefore, the invention can contribute to reducing the number of host interface signal lines. At the same time, the semiconductor integrated circuit device receives a command and data for a sub liquid crystal display drive controller from the host device and can supply the command and data to the sub liquid crystal display drive controller via the parallel interface circuit. Thus, there is no need for interface signal lines coupling the sub liquid crystal display drive controller to the host device. Furthermore, as output terminals of host interface signals for the host interface, the external terminals assigned to the other interface circuits are used for double duty and, consequently, the invention can contribute to reducing the number of external terminals as well.

In one particular aspect of the invention, the other interface circuits include a second serial interface circuit (40) for clock-synchronized serial interfacing at a lower speed than the first serial interface circuit. A serial data output terminal (SDO) assigned to the second serial interface circuit is one external terminal for host interface which is used for double duty to output one (cs) of the interface control signals. In another aspect, the semiconductor integrated circuit device further includes a display data memory (43) capable to be used as a frame buffer of display data which is supplied to the drive circuit and the other interface circuits include a bitmap input control interface circuit (65) for inputting timing control signals for rendering image data which is input via the parallel interface circuit into the frame buffer. As the timing control signals, a data enable signal which indicates that valid data is present, a horizontal synchronization signal, a vertical synchronization signal, and a dot clock which specifies timing for taking in data are input. An input terminal (ENABLE) for the input data enable signal and an input terminal (HSYNC) for the horizontal synchronization signal are the remaining external terminals for host interface which are used for double duty to output the remaining ones (wr, rs) of the interface control signals.

The above predetermined information is information for display control to be supplied to another semiconductor integrated circuit device for display control such as, for example, a sub liquid crystal display drive controller.

The above interface control signals are, for example, a chip select signal (cs), a write signal (wr), and a register select signal (rs).

In a further particular aspect of the invention, the external terminals for host interface are arranged along one (EDG1) of two opposite longitudinal edges of the semiconductor chip and the external terminals for display drive are arranged along the other one (EDG2) of the two opposite longitudinal edges of the semiconductor chip. The external terminals (TML1_b) for host interface assigned to the first serial interface circuit are disposed, spaced apart from the external terminals (TML1_a) for host interface assigned to the parallel interface circuit and other interface circuits, with external terminals for power supply and ground lines being interposed. The arrangement of the terminals is designed such that the terminals for the high-speed interface are hardly affected by inductive noise or cross talk from other signal terminals and signal wirings.

A mobile terminal device according to another aspect of the invention comprises a first casing half (17) and a second casing half (15) foldably coupled to the first casing half via a hinge member (16). The first casing half comprises a host device (5). The second casing half comprises a liquid crystal display drive controller (10) interfaced with the host device via a plurality of signal lines; a liquid crystal display (11) whose display operation is controlled by the liquid crystal display drive controller; a sub liquid crystal display drive controller (12) coupled to the liquid crystal display drive controller; and a sub liquid crystal display (13) whose display operation is controlled by the sub liquid crystal display drive controller. The signal lines go through the hinge member. The liquid crystal display drive controller comprises the above semiconductor integrated circuit device comprising external terminals for host interface; a host interface circuit coupled to the external terminals for host interface; a display drive circuit coupled to the host interface circuit; and external terminals for display drive coupled to the display drive circuit. The host interface circuit comprises a first serial interface circuit for serial data input and output in a differential manner; a parallel interface circuit; and other interface circuits, wherein an interface circuit for use as an interface with a host device is selected according to a host interface mode setting. When the first serial interface circuit is selected for use as the interface with the host device, the host interface circuit outputs in parallel information for the sub liquid crystal display drive controller, input from the host device via the first serial interface circuit, from the parallel interface circuit to the sub liquid crystal display drive controller and generates interface control signals for the parallel output, wherein external terminals for host interface assigned to the other interface circuits are used for double duty to output the generated interface control signals to the sub liquid crystal display drive controller. According to this aspect of the invention, a high-speed serial interface is used as the interface between the liquid crystal display drive controller and the host device and, therefore, the invention can contribute to reducing the number of host interface signal lines going through the hinge member. At the same time, the liquid crystal display drive controller receives a command and data for the sub liquid crystal display drive controller from the host device and can supply the command and data to the sub liquid crystal display drive controller via the parallel interface circuit. Thus, there is no need for wiring of interface signal lines through the hinge member to couple the sub liquid crystal display drive controller to the host device. Furthermore, as output terminals of host interface signals for the host interface, the external terminals assigned to the other interface circuits are used for double duty and, consequently, the invention can contribute to reducing the number of external terminals as well.

Advantageous effects that will be achieved by typical aspects of the invention disclosed in the present application will be briefly described below.

It is possible to suppress an increase in the number of output terminals of interface control signals for control of parallel interface to an external component.

It is possible to achieve cost reduction in terms of the number of external terminals of a liquid crystal display drive controller in a mobile terminal device with casing halves in which one casing half enclosing liquid crystal display drive controllers and a plurality of displays is foldably hinged to the other casing half via a hinge member.

DETAILED DESCRIPTION OF THE PREFERRED EMBODIMENTS

Figure 2:
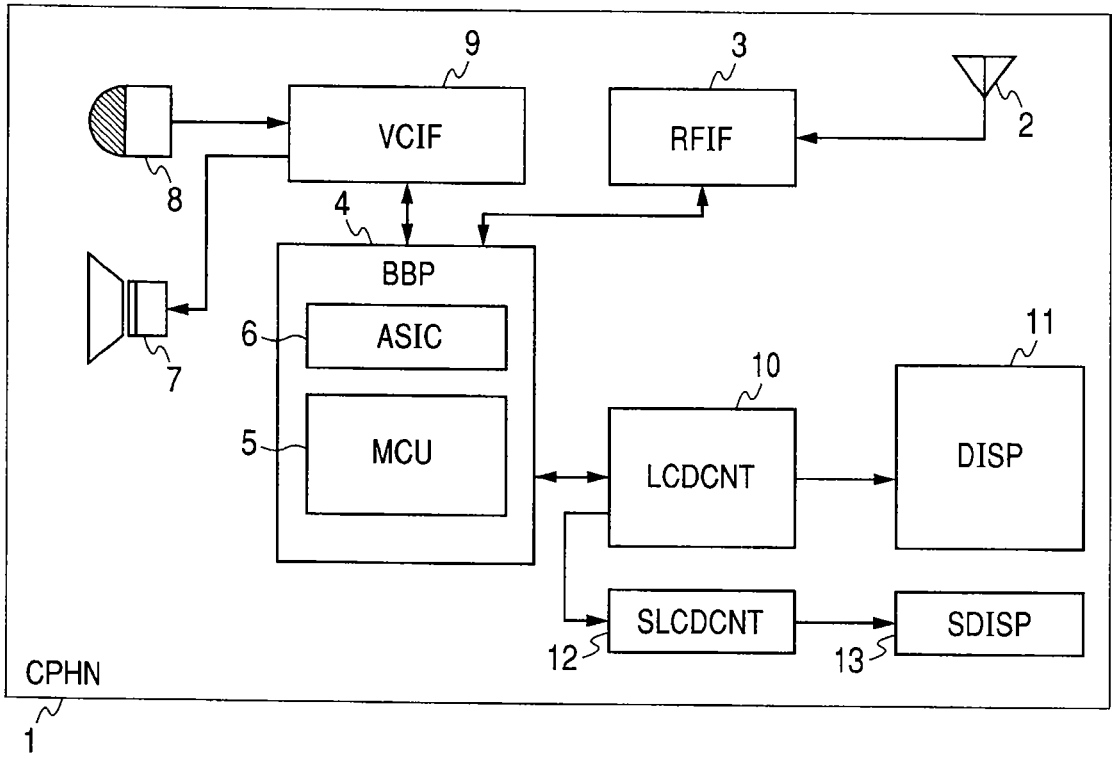
FIG. 2 is a block diagram showing a schematic structure of a mobile phone.

《Mobile phone》 FIG. 2 illustrates an example of a mobile phone 1. A radio band signal received by an antenna 2 is passed to a radio frequency interface (RFIF) section 3. The received signal is converted into a lower frequency signal by the RFIF section 3, demodulated, and converted into a digital signal which is supplied to a baseband section (BBP) 4. The baseband section 4 performs channel codec processing, decrypts the received digital signal, and performs an error correction on the signal, using a data processor (MCU) 5 such as a microcomputer or a micro controller unit. The BBP then separates the received signal data into control data required for communication and communication data such as compressed voice data, using an application specific semiconductor device (ASIC) 6. The control data is passed to the MCU 5 and the MCU performs communication protocol processing or the like on the control data. The voice data extracted by channel codec processing is decompressed by using the MCU 5 and a voice interface circuit (VCIF) 9 converts the decompressed voice data into an analog signal which is reproduced as voice by a speaker 7. In transmitting operation, a voice signal input from a microphone 8 is converted into a digital signal by the VCIF circuit 9. The digital signal is filtered and converted into compressed voice data by using the MCU 5 or the like. The ASIC 6 combines the compressed voice data and control data from the MCU into a transmission data string and adds error correction and detection codes and an encryption code to the data string by using the MCU, thus generating transmission data. The transmission data is modulated by the RFIF section 3 and the modulated transmission data is converted into an RF signal which is, after amplified, transmitted by the antenna 2 as a radio signal.

The MCU 5 issues a display command, display data, and the like to a liquid crystal display drive controller (LCDCNT) 10. The LCDCNT 10 performs control of displaying an image on a liquid crystal display 11 according to the issued display command and display data or transfers the display command and display data to a sub liquid crystal display drive controller (SLCDCNT) 12 for control to enable displaying an image on a sub liquid crystal display (SDISP) 13. The MCU 5 comprises circuit units such as a central processing unit (CPU) and a digital signal processor (DSP). The MCU 5 may be configured to have separate processors: a baseband processor dedicated to baseband processing tasks for communication and an application processor dedicated to additional function control tasks such as display control and security control. Although not restrictive, in the illustrated embodiment, the LCDCNT 10, SLCDCNT 12, ASIC 6, and MCU 5 are configured by independent semiconductor devices, respectively. The MCU is assumed as a host device to the LCDCNT 10.

Figure 3:
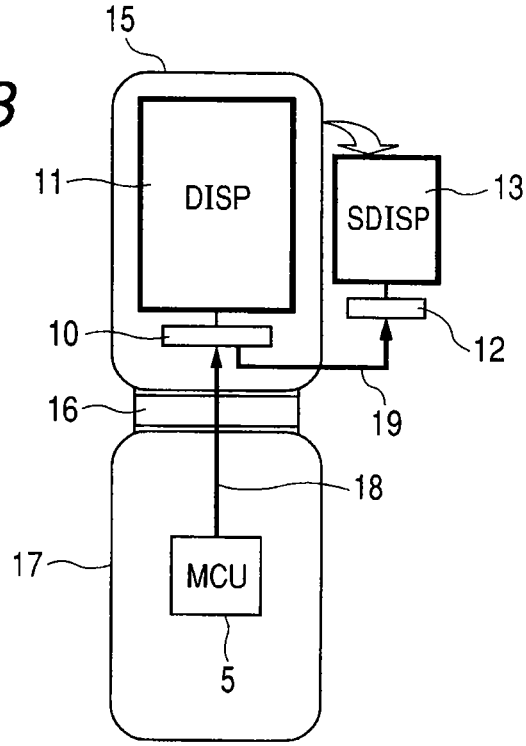
FIG. 3 is an illustration showing a transfer path of a display command and display data in the mobile phone shown in FIG. 2.
Figure 4:
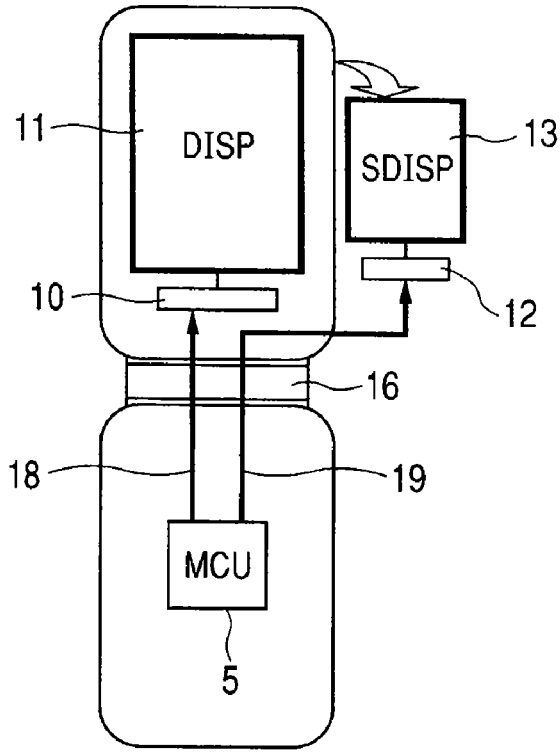
FIG. 4 is a block diagram showing a comparison example of a mobile phone in which a main liquid crystal display drive controller and a sub liquid crystal display drive controller are interfaced to the host device by separate interface signal lines.
Figure 5:
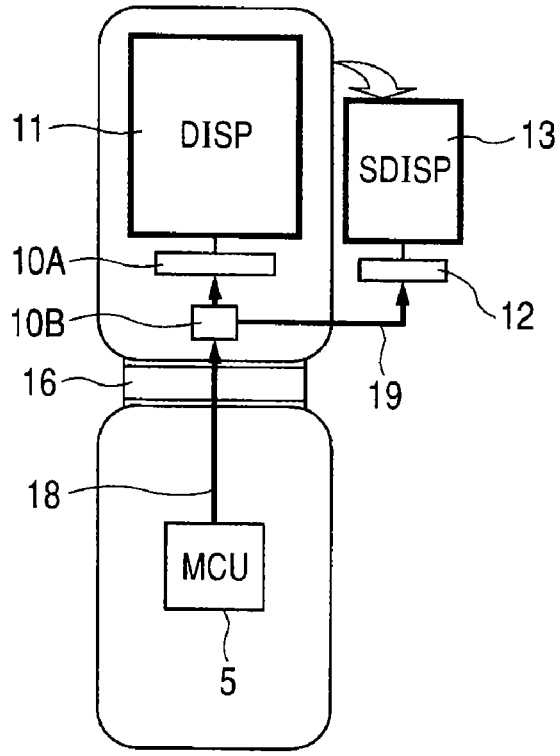
FIG. 5 is a block diagram showing another comparison example of a mobile phone in which a main liquid crystal display drive controller without a differential serial interface function is interfaced in parallel to the host device via a bridge circuit.

FIG. 3 shows a path of transfer of a display command and display data in the mobile phone shown in FIG. 2. Here, the mobile phone has a second casing half 15 and a first casing half 17 foldably coupled to the second casing half 15 via a hinge member 16. The second casing half 15 includes the LCDCNT 10 and the SLCDCNT 12 as well as the liquid crystal display 11 and the sub liquid crystal display 13 which are driven by these controllers. In FIG. 3, it should be appreciated that the SLCDCNT 12 and SDISP 13 are placed on the reverse side of the second casing half 15. The first casing half 17 includes the MCU 5 as the host device. It also includes a plurality of signal lines 18 coupling the LCDCNT 10 and the MCU 5. The signal lines 18 go through the hinge member 16. Some of the signal lines 18 are differential signal lines for information transfer by high-speed serial interfacing. The SLCDCNT 12 is coupled to the LCDCNT 10 by a plurality of signal lines 19. A display command and display data are parallel transferred to the SLCDCNT 12 through the signal lines 19. High-speed serial interfacing with low amplitude between the LCDCNT 10 and the MCU 5 can be implemented by using the differential signal lines. These lines can provide a required transfer rate even with fewer signal lines than the bus signal lines 19 for parallel interfacing. As a result, the signal lines wired between the LCDCNT 10 and the MCU 5 can be lessened and a risk of breaking of the signal lines 18 for aging, as the casing half is folded and unfolded on the hinge member 16 habitually, can be reduced significantly. Since the signal lines 19 do not go through the hinge member 16, they can convey a display command and display data by parallel transfer. In cases like a comparison example which is shown in FIG. 4, where the signal lines 19 are also drawn from the MCU 5 and wired through the hinge member 16, the risk of breaking of the signal lines 18, 19 at the hinge member 16 increases. Another comparison example which is shown in FIG. 5 adopts a display drive controller 10A without the differential serial interface function using the signal lines 18 and, instead, adopts a bridge circuit chip 10B having a bridge function between the differential serial interface and the parallel interface. In this case, one additional chip as the bridge circuit chip 10B becomes necessary and the bridge circuit chip 10B must take a function of signal distribution to, inter alia, the sub liquid crystal display drive controller 12 for the sub display as well as the liquid crystal display drive controller 10A, which introduces a risk of making the control more complicated and deteriorating usability.

Figure 1:
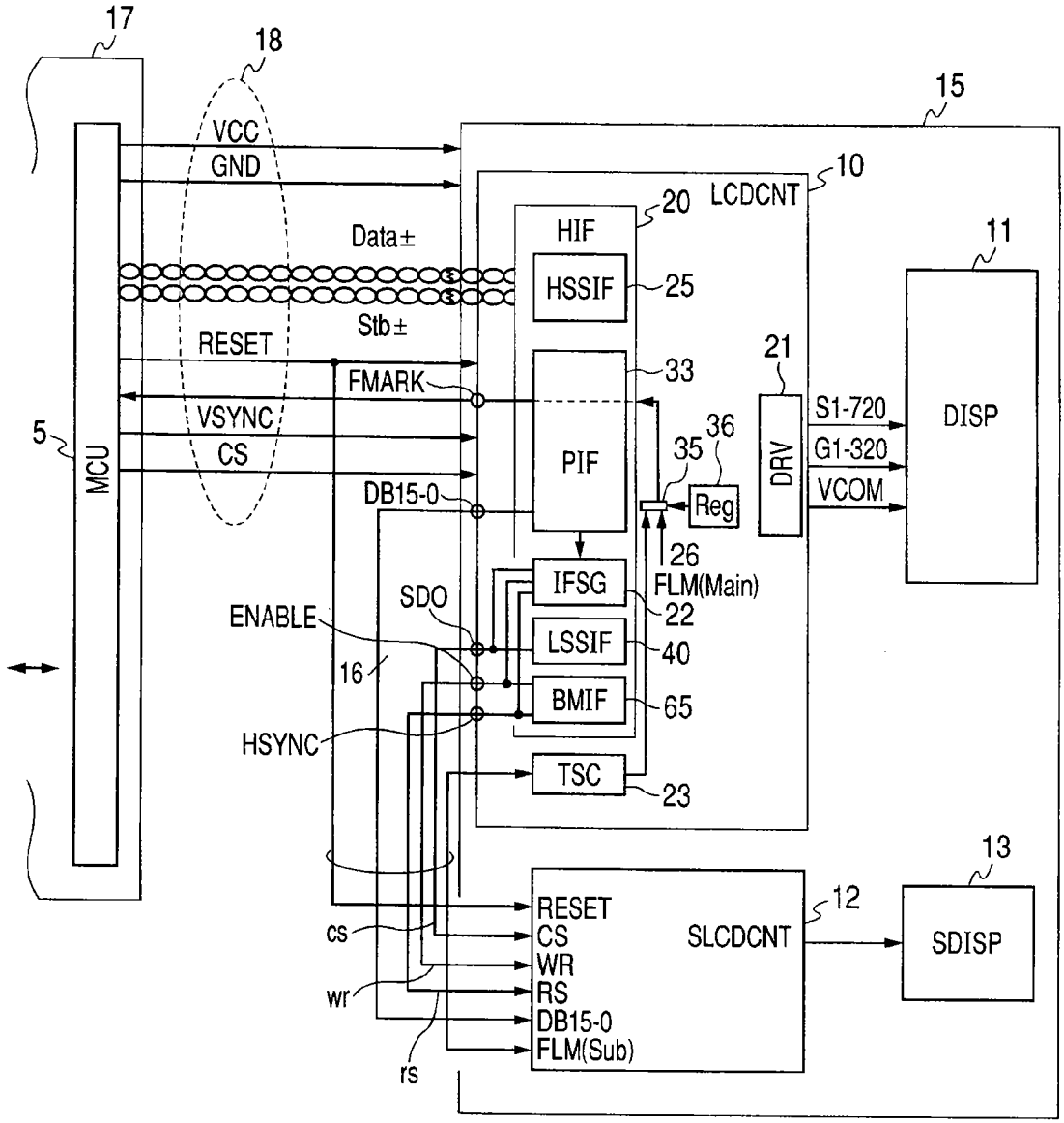
FIG. 1 is a block diagram illustrating the details of an interface configuration in a mobile phone using a liquid crystal display drive controller interfaced to the host device via a high-speed serial interface circuit.

FIG. 1 illustrates the details of circuitry enclosed in the second casing half 15, configured such that high-speed serial interfacing shown in FIG. 3 is performed. The liquid crystal display drive controller 10 includes a host interface circuit (HIF) 20, a display drive circuit (DRV) 21, and an input circuit (TSC) 23. The host interface circuit 20 is used for coupling to the MCU 5 as the host device. The display drive circuit 21 outputs a display drive signal to the liquid crystal display 11, based on display data supplied from the host interface circuit 20.

In the configuration of FIG. 1, the host interface circuit 20 interfaces input/output of commands and data from/to the host device by means of a high-speed serial interface circuit (HSSIF) 25 for serial data input and output in a differential manner. The host interface circuit 20 includes, in addition to the HSSIF 25, a parallel interface circuit (PIF) 33 and a clock-synchronized serial interface circuit (LSSIF) 40 for clock-synchronized serial interfacing at a lower speed than the HSSIF 25; these interface circuits are also capable of interfacing input/output of commands and data from/to the host device. Which interface circuit is used is determined depending on the setting of a mode terminal or a mode register.

The high-speed serial interface circuit (HSSIF) 25 performs serial interfacing with differential signal lines. To the high-speed serial interface, two differential data terminals data± and two differential strobe signal terminals Stb± are assigned. The clock-synchronized serial interface circuit 40 controls serial input and output synchronized with a clock.

The parallel interface circuit 33 has parallel data terminals 15-0 at which data is input and output and takes input of a chip select signal, a register select signal, a write signal, and a read signal which are interface control signals for parallel interfacing. Although not restrictive, an access control signal that is used for access to an external bus of a Z80 microprocessor is considered to be used for the parallel interface assumed herein.

The host interface circuit 20 also includes a bitmap input control interface circuit (BMIF) 65 which is made available along with image data input via the parallel interface circuit 33. The bitmap input control interface circuit (BMIF) 65 is a circuit for inputting timing control signals for rendering image data which is input via the parallel interface circuit 33 into the frame buffer. These signals are used when, for example, moving image data sent from the host device is received and written into the frame buffer, and displaying the moving image is controlled with the display drive circuit 21. The timing control signals which are input through the bitmap input control interface circuit 65 are a data enable signal which indicates that valid data is present, a horizontal synchronization signal, a vertical synchronization signal, and a dot clock which specifies timing for taking in data.

When the high-speed serial interface circuit 25 is selected for use as the interface with the host device, the host interface circuit 20, upon receiving a command and display data for the sub liquid crystal display drive controller 12 from the host device, outputs the command and display data to the sub liquid crystal display drive controller 12 via the parallel data input/output terminals DB15-0 of the parallel interface circuit 33 and generates interface control signals for the parallel output by means of an interface control signal generating circuit (IFSG) 22. The interface control signal generating circuit 22 generates the interface control signals in response to receiving a command and display data for the sub liquid crystal display drive controller 12 by the high-speed serial interface circuit. To output the generated interface control signals, a serial output terminal SDI assigned to the low-speed (clock-synchronized) serial interface circuit and an external input terminal ENABLE for the enable signal and an external input terminal HSYNC for the horizontal synchronization signal assigned to the bitmap input control interface circuit 65 are used for double duty. Timing of outputting parallel data for the sub liquid crystal display drive controller 12 is synchronized with the output of the interface control signals. The interface control signals for the parallel output are specifically a chip select signal cs, a register select signal rs, and a write signal wr. Thus, the number of external terminals can be lessened as compared with a case where dedicated terminals like port terminals are assigned to output the interface control signals for the parallel output of a command and display data to the sub liquid crystal display drive controller 12. A read signal is not necessary as an interface control signal for the sub liquid crystal display drive controller 12, because the sub display drive controller only receives a command and display data from the liquid crystal display drive controller 10.

The host interface circuit 20 generates a frame sync signal to specify timing for taking in display data by frame-by-frame synchronization. The frame sync signal is output from a frame sync signal output terminal FMARK. For example, the frame sync signal is generated based on a signal FLM (main) indicating the start of a frame of display data and its pulse changes corresponding to the start point of each frame of display data. The signal FLM (main) is an internal control signal that changes in sync with the start of each frame of display data when the display data is written into the frame buffer and the FLM is generated by a timing control circuit (timing generator 50 in FIG. 7) which controls display timing. The liquid crystal display drive controller 10 supplies this frame sync signal to the MCU 5, so that the MCU 5 can supply display data and the like in sync with the frame sync signal to the liquid crystal display drive controller 10.

An input circuit 23 is provided to allow the sub liquid crystal display drive controller 12 to take in display data in sync with the start of each frame. That is, the input circuit 23 takes input of a signal FLM (sub) which is output by the sub liquid crystal display drive controller 12 and allows this signal to be output from the terminal FMARK. Specifically, when the host interface circuit 20 outputs display data and the like to be displayed on the sub display under the control of the sub liquid crystal display drive controller 12, received by the high-speed serial interface circuit 25, from the parallel interface circuit 33 to the sub liquid crystal display drive controller 12, the input circuit 23 takes input of the signal FLM (sub) output from the sub liquid crystal display drive controller 12. The input signal FLM (sub) is selected by a selector 35, instead of the signal FLM (main) generated internally in the liquid crystal display drive controller 10, and output from the terminal FMARK to the MCU 5. Control of the selector 35 can be performed in accordance with control data set in a register 36. Thereby, even when the liquid crystal display drive controller 10 supplies display data to the sub liquid crystal display drive controller 12 for sub display, the sub liquid crystal display drive controller 12 can take in display data in synch with the start of each frame.

The signal lines 18 further include a reset signal line RESET, a vertical synchronization signal line VSYNC, a signal CS to the liquid crystal display drive controller 10, a voltage supply line VCC, and a ground supply line GND. The reset signal line RESET is used to initialize the liquid crystal display drive controllers 10, 12. The vertical synchronization signal line VSYNC is used to control a synchronized display of moving images typified by video telephony and the like. If the high-speed serial interface circuit is used as the interface with the host, the signal CS is used as an interrupt signal to wake up the liquid crystal display drive controller 12 from sleep mode. If the parallel interface circuit 33 is used as the interface with the host, the signal CS functions as a chip select signal to the liquid crystal display drive controller 10.

Figure 6:
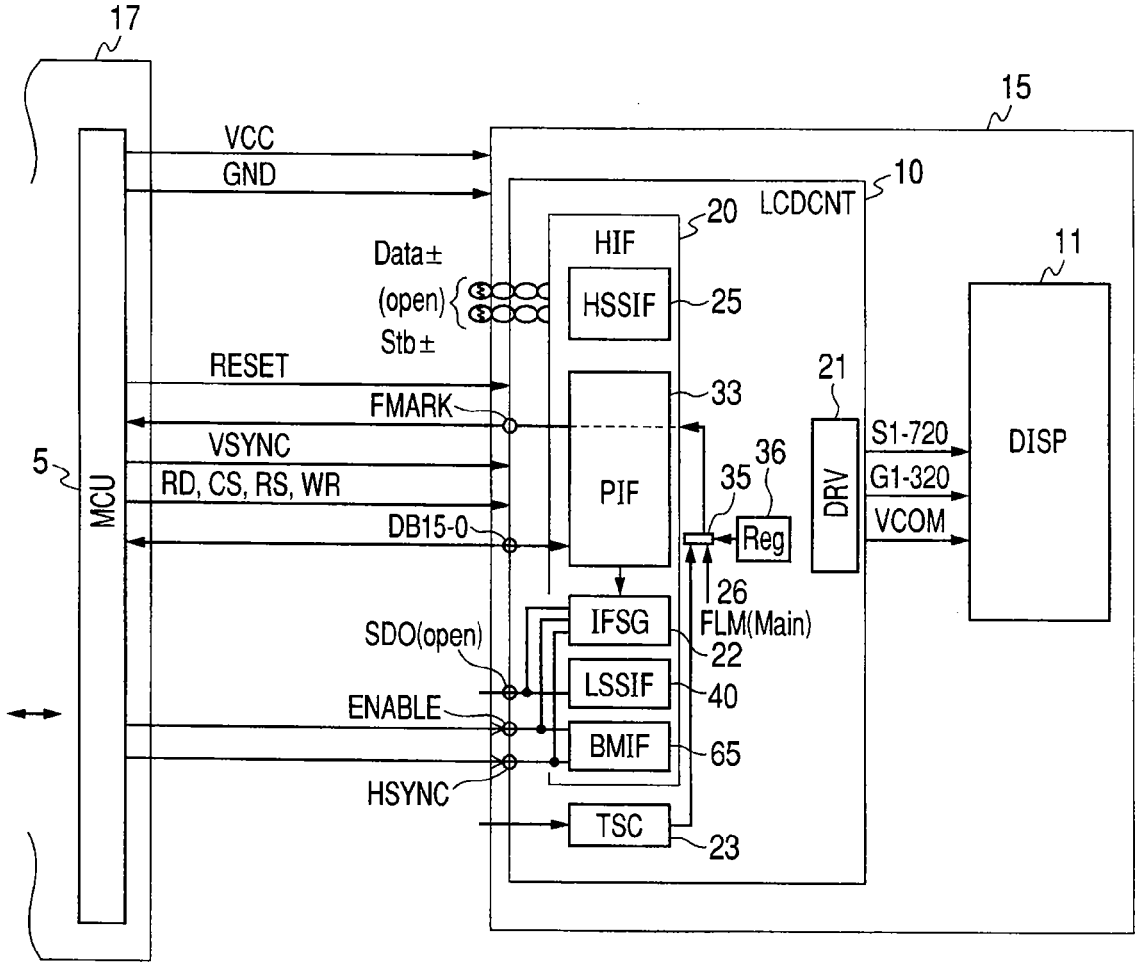
FIG. 6 is a block diagram illustrating a host interface configuration in a case where a parallel interface is adopted by another selectable host interface function to FIG. 1.

FIG. 6 illustrates a state of the host interface when a host interface function using the parallel interface circuit 33 is selected.

If the parallel interface function is selected, the host interface circuit 20 interfaces with the host, namely, the MCU 5 mainly by the parallel interface circuit 33. Parallel interfacing with the MCU 5 is performed via the following lines: reset signal RESET, frame mark signal FMARK, chip select signal CS, write signal WR, register select signal RS, read signal RD, and parallel data DB15-0. Furthermore, along with image data input via the parallel interface circuit 33, it is also possible to use the bitmap input control interface circuit (BMIF) 65 through which a data enable signal ENABLE and a horizontal synchronization signal HSYNC are input from the host device. Since the high-speed serial interface circuit 25 and the clock-synchronized serial interface circuit 40 are not in use, the terminals assigned to them, such as Data±, Stb±, and SDO are, for example, set in a floating (Open) state. In a case where, as the host interface function, the parallel interface is adopted instead of the high-speed serial interface, the number of the signal lines 38 required for interfacing with the host increases to several tens of lines. A situation where the interface aspect as shown in FIG. 6 must be adopted actually is an instance where the MCU 5 does not have the function of interfacing with the high-speed serial interface circuit 25. In this case, the effect of reducing the number of wired lines going through the hinge member 16, as shown in FIG. 1, cannot be obtained naturally. In FIG. 6, the sub liquid crystal display drive controller 12 and the sub liquid crystal display 13 are used, the signal lines of the parallel interface wired between the liquid crystal display drive controller 10 and the host device may be branched on the first casing half side and coupled to corresponding terminals of the sub liquid crystal display drive controller 12.

Figure 7:
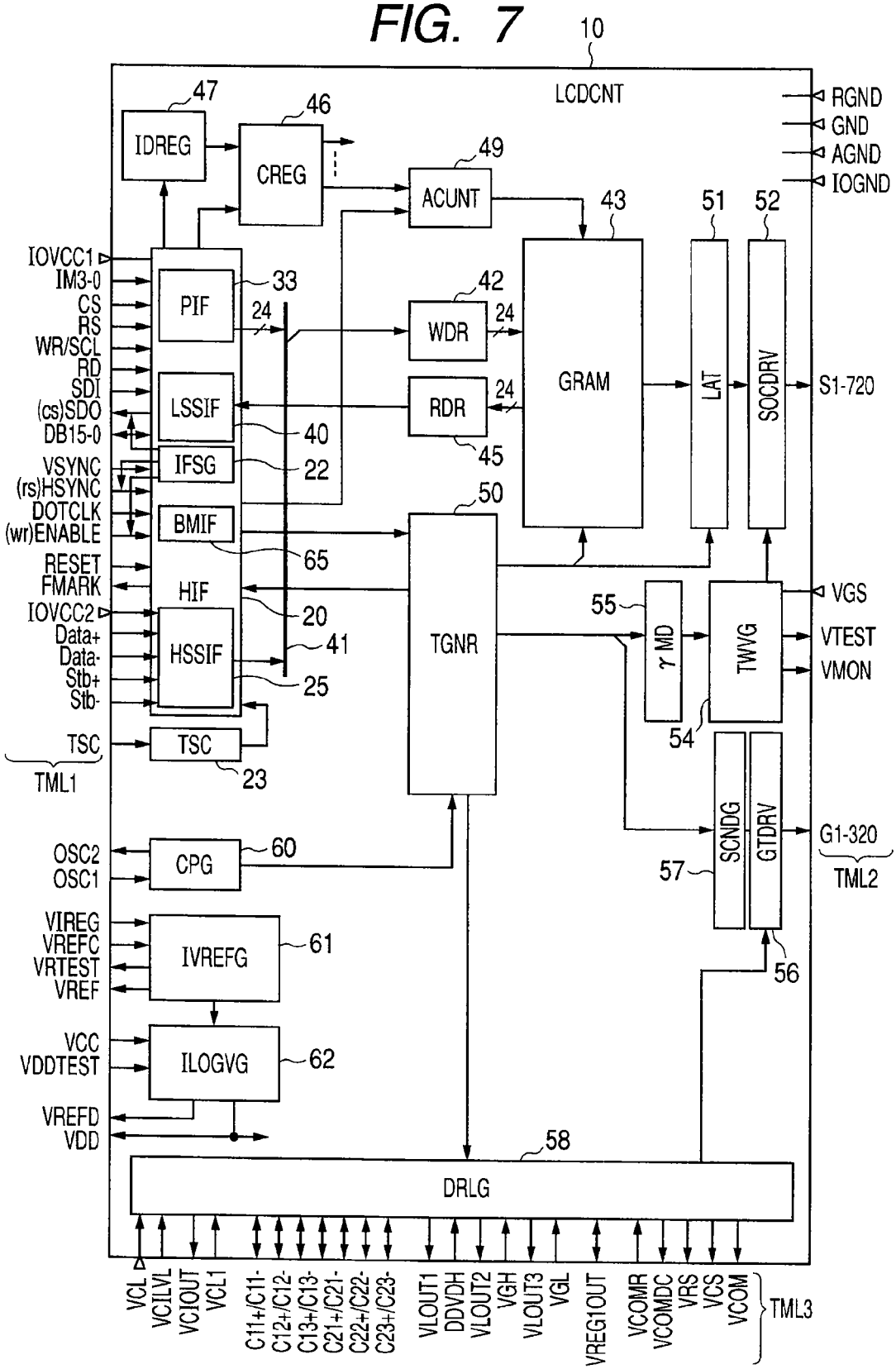
FIG. 7 is a block diagram illustrating a detailed structure of a liquid crystal display drive controller.

《Liquid crystal display drive controller》 FIG. 7 illustrates a detailed structure of the liquid crystal display drive controller 10. The liquid crystal display drive controller 10 includes external terminals TML1 for host interface, the host interface circuit 20 coupled to the external terminals TML1 for host interface, the display drive circuit 21 coupled to the host interface circuit 20, external terminals TMK2 for display drive coupled to the display drive circuit, and other components.

The host interface circuit 20 includes the high-speed serial interface circuit (HSSIF) 25 for serial data input and output in a differential manner, the parallel interface circuit (PIF) 33, the clock-synchronized serial interface circuit (LSSIF) 40 for clock-synchronized serial interfacing at a lower speed than the HSSIF 25, the bitmap image input control interface circuit (BMIF) 65, and the interface control signal generating circuit (IFSG) 22.

The high-speed serial interface circuit (HSSIF) 25 performs serial interfacing with differential signal lines. To the high-speed serial interface, two differential data terminals data± and two differential strobe signal terminals Stb± are assigned. The clock-synchronized serial interface circuit 40 controls serial input and output synchronized with a clock. A specific transfer protocol for the high-speed serial interface is not described restrictively herein. However, for example, the transmitter side of the interface sends data through the differential data terminals data± in sync with edge changes of clock signals present at the differential strobe signal terminals Stb± and the receiver side takes in data present at the differential data terminals data± for each fixed period of clock signals present at the differential strobe signal terminals Stb±. Determining whether a signal is "1" or "0" may be made depending on a direction of a differential current. Preferably, transfer rate is set at a high rate, e.g., 100-400 Mbps, and signal amplitude is set at a low amplitude, e.g., 300 mV.

Parallel data terminals DB0-15, a chip select terminal CS, a register select terminal RS, a write terminal WR, and a read terminal RD are assigned to the parallel interface circuit 33. Although not restrictive, an access control signal that is used for access to an external bus of a Z80 microprocessor is considered to be used for the parallel interface assumed herein.

The clock-synchronized serial interface circuit 40 serves for serial input and output of data, using a serial input terminal SDI and a serial output terminal SDO. The amplitude of a signal that is transferred through theses terminals SDI, SDO is as high as about 1.5 V and the transfer rate is low.

The bitmap image input control interface circuit (BMIF) 65 is a circuit for inputting timing control signals for rendering image data which is input via the parallel interface circuit 33 into the frame buffer. The timing control signals are used when, for example, moving image data sent from the host device is received and written into the frame buffer, and displaying the moving image is controlled with the display drive circuit 21. The timing control signals which are input through the bitmap image input control interface circuit 65 are a data enable signal ENABLE which indicates that valid data is present, a horizontal synchronization signal HSYNC, a vertical synchronization signal VSYNC, and a dot clock DOTCLK which specifies timing for taking in data.

For input and output of a command and display data from/to the MCU 5 as the host device, the parallel interface circuit 33, the high-speed serial interface circuit 25, or the low-speed serial interface circuit 40 can be used. Which interface is used is determined depending on the pulled-up or pulled-down state of each mode terminal IM3-0. If the high-speed serial interface is selected, the interface configuration as shown in FIG. 1 can be realized. If the parallel interface is selected, the interface configuration as shown in FIG. 6 can be realized. If the low-speed serial interface is selected, the interface configuration in FIG. 6 wherein the low-speed serial interface is used instead of the parallel interface can be realized. As the interface configuration between the liquid crystal display drive controller 10 and the MCU 5 is selectable in this way, flexibility in the system configuration can be ensured.

Packets in a predetermined format are used for transfer of a command and data between the MCU 5 and the host interface circuit 20. If the high-speed interface circuit is used as the host interface, it receives a command and display data from the differential data terminals data±. If the parallel interface is used as the host interface, it receives a command and display data from the data input/output terminals DB15-0. When the low-speed serial interface is used as the host interface, it receives a command and display data from the serial data input terminal SDI. If the parallel interface is used as the interface with the MCU 5, the chip select signal CS, write signal WR, read signal RD, and register select signal RS are input as the interface control signals from the host device 5. The chip select signal CS means a chip selection when the signal level is low. The write signal WR is defined herein as a write strobe signal that means writing when the signal level is low. The read signal RF is defined herein as a read strobe signal that means reading when the signal level is low.

When the host interface circuit 20 receives a command packet from the MCU 5, it stores address information received by the packet into an index register (IDREG) 47. The index register 47 generates a register select signal or the like by decoding the command address stored therein. Command data received by the packet is supplied to a command data register array (CREG) 46. The command register array 46 comprises a large number of command data registers mapped to predetermined addresses. A command data register into which the received command is to be stored is selected by the register select signal that is output from the index register 47. The command data latched into the selected command data register is supplied as an instruction or control data to the appropriate circuit portion for control of internal operation. It is also possible to write a command directly into a command data register designated by the address information of a command packet, according to the packet header information. If the parallel interface is selected, the direct writing of a command into a command data register is indicated by a high level of the register select signal RS.

When the host interface circuit 20 receives a data packet from the MCU 5, the host operates as follows: according to the packet header information, it writes the data into a register such as a write data register 42 whose address is designated by the address information or reads data from a register such as a read data register 45 whose address is designated by the address information, and sets the address information into an address counter 49. The address counter 49 performs an increment operation or the like in accordance with the contents of the command data register to which the address information refers and performs addressing within a display data memory (GRAM) 43. At this time, if the command data specifies a write access operation to the display data memory 43, the data contained in the data packet is supplied via a bus 41 to the write data register (WDR) 42 and stored into the display data memory (GRAM) 43 at precise timing. Storing display data is performed, for example, in units of display data frames or the like. If the command data specifies a read access operation from the display data memory 43, data stored in the display data memory 43 is read to the read data register (RDR) 45 from which the data can be supplied to the MCU 5. When the command data register receives a display command, a read operation from the display data memory 43 is performed in sync with displaying timing. Timing control of reading and displaying is performed by a timing generator (TGNR) 50. Display data which has been read from the display data memory 43 in sync with displaying timing is latched into a latch circuit (LAT) 51. The latched data is supplied to a source driver (SOCDRV) 52. The liquid crystal display 11 whose driving is controlled by the liquid crystal display drive controller 10 consists of a dot matrix type liquid crystal panel comprising thin film transistors (TFTs). The liquid crystal panel further includes a large number of source electrodes as signal electrodes and a large number of gate electrodes as scanning electrodes for driving pixels. The source driver (SOCDRV) 52 drives the source electrodes of the liquid crystal display 11 via drive terminals S1-720. The drive levels of the drive terminals S1-720 are determined by tone voltages generated by a tone voltage generating circuit (TWVG) 54 and applied to these terminals. The tone voltages can be gamma-modified by a gamma modification circuit (γMD) 55. A scanning data generating circuit (SCNDG) 57 generates data for scanning in sync with scanning timing from the timing generator 50. The data for scanning is supplied to a gate driver (GTDRV) 56. The gate driver 56 drives the gate electrodes of the liquid crystal display 11 via drive terminals G1-320. The drive levels of the drive terminals G1-320 are determined by drive voltages generated by a liquid crystal display drive level generating circuit (DRLG) 58 provided with charge pumping circuits and applied to these terminals. A plurality of external terminals TML3 attached to the DRLG 58 are external terminals such as capacitor elements for constituting the charge pumping circuits.

A clock pulse generator (CPG) 60 takes input of a source oscillation clock from terminals OSC1, OSC2, generates an internal clock, and supplies it as a reference clock for operation timing to the timing generator 50. An internal reference voltage generating circuit (IVREFG) 61 generates a reference voltage and supplies it to an internal logic power supply regulator (ILOGVG) 62. The internal logic power supply regulator 62 generates a power supply for internal logics, based on the reference voltage.

When the high-speed serial interface circuit 25 is selected for use as the host interface, the high-speed serial interface circuit 25 determines whether predetermined header information is included in the header of a command packet or data packet. The high-speed serial interface circuit 25 gets to know that the packet is destined for the sub liquid crystal display drive controller 12 upon finding the predetermined header information in the header. Thereupon, the high-speed serial interface circuit 25 passes the packet containing a command or display data to the parallel interface circuit to output it from the data terminals DB15-0 and requests the interface control signal generating circuit (IFSG) 22 to generate a chip select signal cs, register select signal rs, and write signal wr as the interface control signals for the parallel interface. These control signals are output to outside from the serial output terminal SDI assigned to the clock-synchronized serial interface circuit and the external input terminal ENABLE for an enable signal and the external input terminal HSYNC for a horizontal synchronization signal assigned to the bitmap input control interface circuit 65.

Figure 8:
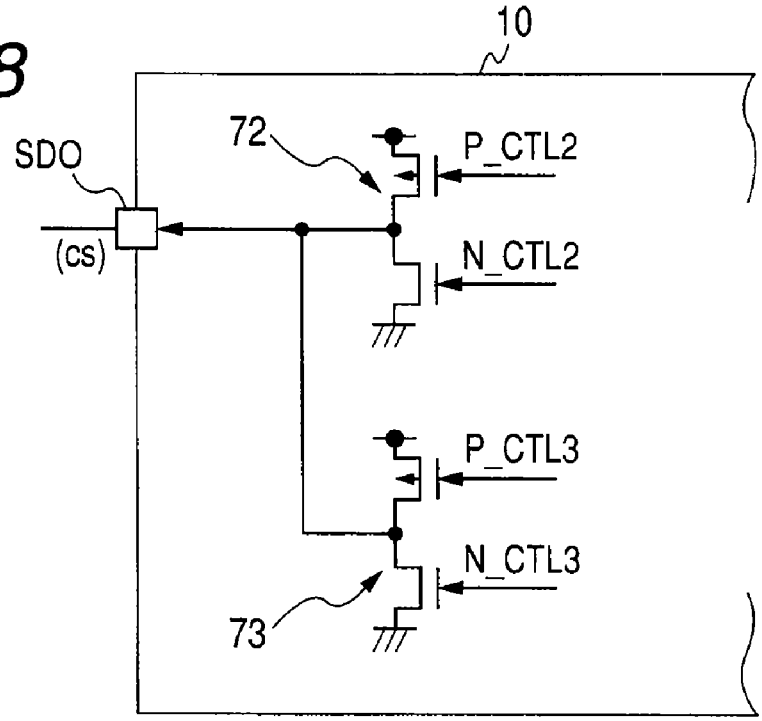
FIG. 8 is a circuit diagram illustrating an input/output buffer circuit when an external input terminal ENABLE for an enable signal is used as a write signal WR output terminal for double duty.

FIG. 8 illustrates an input/output buffer when the external input terminal ENABLE for an enable signal is used as a write signal wr output terminal for double duty. A reference numeral 70 denotes an input buffer gate to which a low enable signal is selectively input and the input is enabled when an input control signal EN_CTL is low. A reference numeral 71 denotes an output buffer for a write signal wr. Its output terminal is coupled to the terminal ENABLE and outputs low level and high level with high level and low level of output control signals P_CTL1, N_CTL1. The output is enabled by complementary levels. This output is controlled to be a high output impedance when one output control signal P_CTL1 is high and the other one N_CTL is low.

Figure 9:
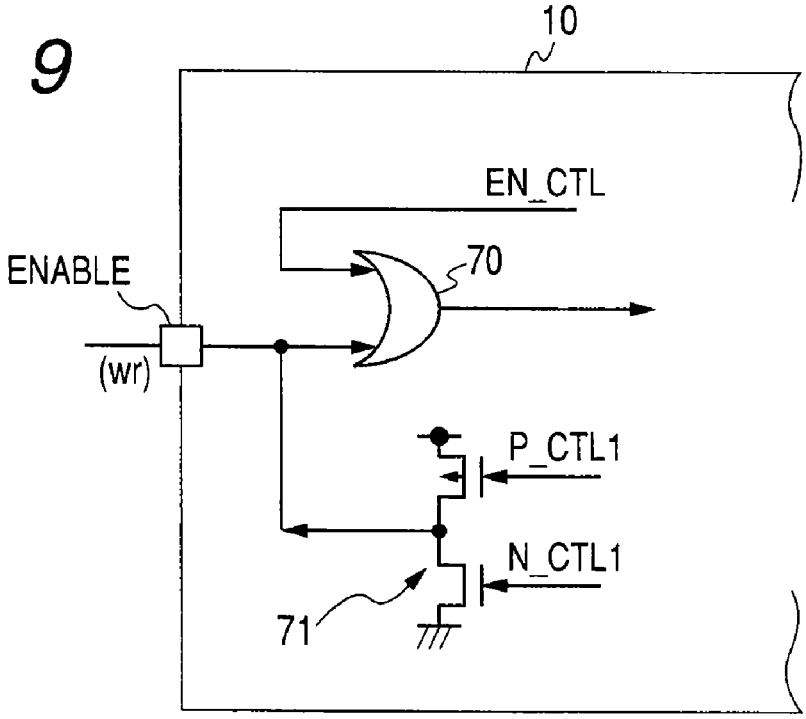
FIG. 9 is a circuit diagram illustrating an output buffer circuit when a serial output terminal SDO is used as a chip select signal CS output terminal for double duty.

FIG. 9 illustrates an output buffer circuit when the serial output terminal SDO is used as a chip select signal cs output terminal for double duty. A reference numeral 72 denotes an output buffer for serial data. Its output terminal is coupled to the terminal SDO and outputs low level and high level with high level and low level of output control terminals P_CTL2, N_CTL2. This output is controlled to be a high output impedance when one output control signal P_CTL2 is high and the other one N_CTL2 is low. A reference numeral 73 denotes an output buffer for a chip select signal cs. Its output is coupled to the terminal SDO and outputs low level and high level with high level and low level of output control signals P_CTL3, N_CTL3. This output is controlled to be a high output impedance when one output control signal P_CTL3" is high and the other one N_CTL3 is low.

Figure 10:
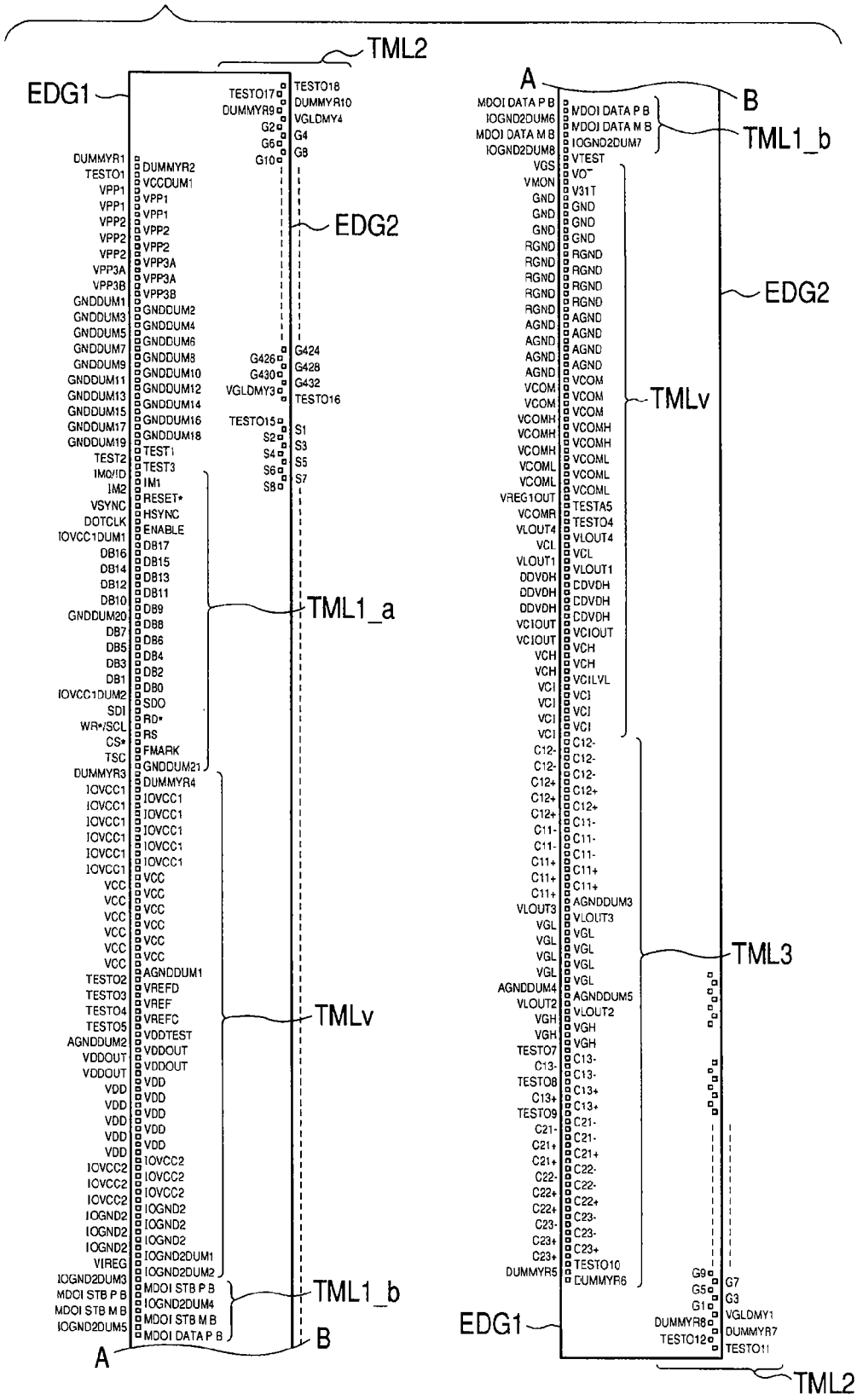
FIG. 10 is a plan view of a semiconductor chip of a liquid crystal display drive controller.

FIG. 10 shows a plan view of a semiconductor chip of a liquid crystal display drive controller 10. The whole chip is cut at plane A-B because of limitation of the drawing space. The external terminals TML1 (TML1_a, TML1_b) for the host interface are arranged along one EDG1 of two opposite longitudinal edges of the semiconductor chip of the liquid crystal display drive controller 10. The external terminals TML2 for the display drive controller are arranged along the other one EDG2 of the two opposite longitudinal edges of the semiconductor chip. Particularly noticeable is that the external terminals TML1_b for host interface assigned to the high-speed serial interface circuit are disposed, spaced apart from the external terminals TML1_a for host interface assigned to the parallel interface circuit and other interface circuits, with external terminals TMLv for power supply and ground lines being interposed therebetween. The arrangement of the terminals is designed so that the terminals TML1_b for the high-speed interface will be hardly affected by inductive noise or cross talk from other signal terminals and signal wirings.

While the present invention has been described specifically based on its illustrative embodiments hereinbefore, it will be appreciated that the present invention is not limited to the described embodiments and various modifications may be made without departing from the gist of the invention.

For example, the term "command" used herein means not only an instruction to be set in a command register, but also control data to be set in a control register such as a port control register. In other words, for either liquid crystal display drive controller, data other than display data is considered to be a command and means instruction data to make directions for an action in any way. In the liquid crystal display drive controller, any of the interface configurations to be used, as shown in FIG. 1 and FIG. 6, can be selected not only by mode terminal setting and also may be selected by register setting. Initializing the registers may be performed by the execution of setup instructions or the like in software, which is autonomously executed by the liquid crystal display device. The host device is not limited to one MCU 5 that is used for baseband processing and application processing. Both a baseband processor and an application processor may take the roles of host devices; moreover, another circuit may operate as a host device. The present invention can broadly be applied to diverse mobile terminal devices such as mobile data processing terminals and storage terminals like a Personal Digital Assistants (PDA), not limited to mobile phones.

What is claimed is:

1. A mobile terminal device comprising:

a first casing half; and a second casing half foldably coupled to said first casing half via a hinge member, wherein said first casing half comprises a host device, wherein said second casing half comprises: a liquid crystal display drive controller interfaced with said host device via a plurality of signal lines; a liquid crystal display whose display operation is controlled by said liquid crystal display drive controller; a sub liquid crystal display drive controller coupled to said liquid crystal display drive controller; and a sub liquid crystal display whose display operation is controlled by said sub liquid crystal display drive controller, wherein said signal lines go through said hinge member, wherein said liquid crystal display drive controller comprises a semiconductor integrated circuit device which includes: external terminals for host interface; a host interface circuit coupled to said external terminals for host interface; a display drive circuit coupled to said host interface circuit; and external terminals for display drive coupled to said display drive circuit, wherein said host interface circuit comprises: a first serial interface circuit for serial data input and output in a differential manner; a parallel interface circuit; and other interface circuits, wherein an interface circuit for use as an interface with a host device is selected according to a host interface mode setting, wherein said host interface circuit, when said first serial interface circuit is selected for use as the interface with said host device, outputs in parallel information for said sub liquid crystal display drive controller, input from said host device via said first serial interface circuit, from said parallel interface circuit to said sub liquid crystal display drive controller and generates interface control signals for the parallel output, and wherein external terminals for host interface assigned to said other interface circuits are used for double duty to output said generated interface control signals to said sub liquid crystal display drive controller.

2. The mobile terminal device according to claim 1, wherein said other interface circuits include a second serial interface circuit for clock-synchronized serial interfacing at a lower speed than said first serial interface circuit, and wherein a serial data output terminal assigned to said second serial interface circuit is one external terminal for host interface which is used for double duty to output one of said interface control signals.

3. The mobile terminal device according to claim 2, further comprising:

a display data memory capable to be used as a frame buffer of display data which is supplied to said drive circuit, wherein said other interface circuits include a bitmap input control interface circuit for inputting timing control signals for rendering image data which is input via said parallel interface circuit into the frame buffer, wherein, as said timing control signals, a data enable signal which indicates that valid data is present, a horizontal synchronization signal, a vertical synchronization signal, and a dot clock which specifies timing for taking in data are input, and wherein an input terminal for said input data enable signal and an input terminal for the horizontal synchronization signal are the remaining external terminals for host interface which are used for double duty to output the remaining ones of said interface control signals.

4. The mobile terminal device according to claim 3, wherein said interface control signals are a chip select signal which instructs to select said sub liquid crystal display drive controller, a write signal to instruct said sub liquid crystal display drive controller to write data, and a register select signal for selecting a register to which to write data.

5. The mobile terminal device according to claim 4, wherein said external terminals for host interface are arranged along one of two opposite longitudinal edges of the semiconductor chip and said external terminals for display drive are arranged along the other one of the two opposite longitudinal edges of the semiconductor chip, and the external terminals for host interface assigned to said first serial interface circuit are disposed, spaced apart from the external terminals for host interface assigned to said parallel interface circuit and other interface circuits, with external terminals for power supply and ground lines being interposed.

6. A semiconductor integrated circuit device comprising:

external terminals for host interface;

a host interface circuit coupled to said external terminals for host interface;

a display drive circuit coupled to said host interface circuit; and external terminals for display drive coupled to said display drive circuit, wherein said host interface circuit comprises a first serial interface circuit for serial data input and output in a differential manner, a parallel interface circuit, and other interface circuits, wherein an interface circuit for use as an interface with a host device is selected according to a host interface mode setting, wherein said host interface circuit, when said first serial interface circuit is selected for use as the interface with said host device, outputs in parallel predetermined information input from said host device via said first serial interface circuit from said parallel interface circuit to outside and generates interface control signals for the parallel output, and wherein external terminals for host interface assigned to said other interface circuits are used for double duty to output said generated interface control signals.

7. The semiconductor integrated circuit device according to claim 6, wherein said other interface circuits include a second serial interface circuit for clock-synchronized serial interfacing at a lower speed than said first serial interface circuit, and wherein a serial data output terminal assigned to said second serial interface circuit is one external terminal for host interface which is used for double duty to output one of said interface control signals.

8. The semiconductor integrated circuit device according to claim 7, further comprising:

a display data memory capable to be used as a frame buffer of display data which is supplied to said drive circuit, wherein said other interface circuits include a bitmap input control interface circuit for inputting timing control signals for rendering image data which is input via said parallel interface circuit into the frame buffer, wherein, as said timing control signals, a data enable signal which indicates that valid data is present, a horizontal synchronization signal, a vertical synchronization signal, and a dot clock which specifies timing for taking in data are input, and wherein an input terminal for said input data enable signal and an input terminal for the horizontal synchronization signal are the remaining external terminals for host interface which are used for double duty to output the remaining ones of said interface control signals.

9. The semiconductor integrated circuit device according to claim 8, wherein said predetermined information is information for display control to be supplied to another semiconductor integrated circuit device for display control.

10. The semiconductor integrated circuit device according to claim 9, wherein said interface control signals are a chip select signal, a write signal, and a register select signal.

11. The semiconductor integrated circuit device according to claim 10, wherein said external terminals for host interface are arranged along one of two opposite longitudinal edges of the semiconductor chip and said external terminals for display drive are arranged along the other one of the two opposite longitudinal edges of the semiconductor chip, and the external terminals for host interface assigned to said first serial interface circuit are disposed, spaced apart from the external terminals for host interface assigned to said parallel interface circuit and other interface circuits, with external terminals for power supply and ground lines being interposed.

* * * * *